United States Patent [19]

Wallin et al.

[11] 4,212,731

[45] Jul. 15, 1980

[54] DRIVE DEVICE WITHOUT TRANSMISSION FOR PRODUCING AN ELLIPTICAL SHAKING MOVEMENT

[75] Inventors: Hans-Henrik B. Wallin, Smedjebacken; Eric R. Ericsson, Ludvika, both of Sweden

[73] Assignee: Morgardshammar Aktiebolag, Smedjebacken, Sweden

[21] Appl. No.: 922,597

[22] Filed: Jul. 7, 1978

[30] Foreign Application Priority Data

Jul. 13, 1977 [SE] Sweden ..... 7708140

[51] Int. Cl.[2] ..... B07D 1/44

[52] U.S. Cl. ..... 209/366.5; 74/61

[58] Field of Search ..... 209/366.5, 367; 74/61, 74/87

[56] References Cited

U.S. PATENT DOCUMENTS

| | | | |
|---|---|---|---|
| 2,542,227 | 2/1951 | Bernhard | 74/61 |
| 2,938,393 | 5/1960 | Dunn et al. | 74/61 |
| 3,053,379 | 9/1962 | Röder et al. | 209/366.5 X |
| 3,226,989 | 1/1966 | Robins | 209/367 |
| 3,659,465 | 5/1972 | Oshima et al. | 74/61 |

FOREIGN PATENT DOCUMENTS

| | | |
|---|---|---|
| 2356542 | 5/1975 | Fed. Rep. of Germany . |
| 62136 | 6/1955 | France . |
| 163270 | 5/1958 | Sweden . |
| 445166 | 2/1968 | Switzerland . |

*Primary Examiner*—William A. Cuchlinski, Jr.

[57] ABSTRACT

A drive device for oscillating a spring-suspended device, such as a sieve or transport device, into an elliptical translational movement with a minimum of rotation. Two unequal and eccentrically arranged oscillation masses, rotatably fixed to the device, are rotationally driven each by a motor independent of the other. If the axes of rotation for the two masses are arranged in a certain geometry relative to the center of mass, the device will oscillate with a substantially pure translational, elliptical movement free of tipping movement.

3 Claims, 7 Drawing Figures

FIG. 1
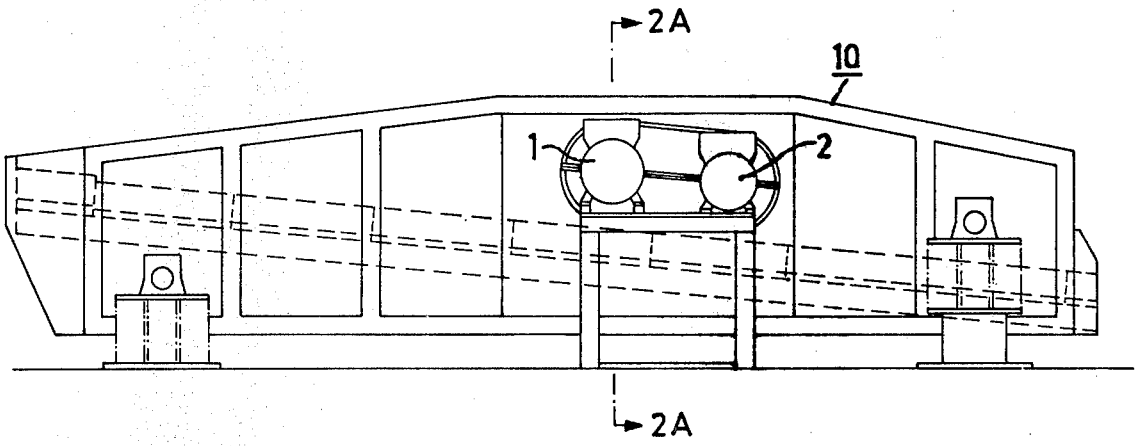
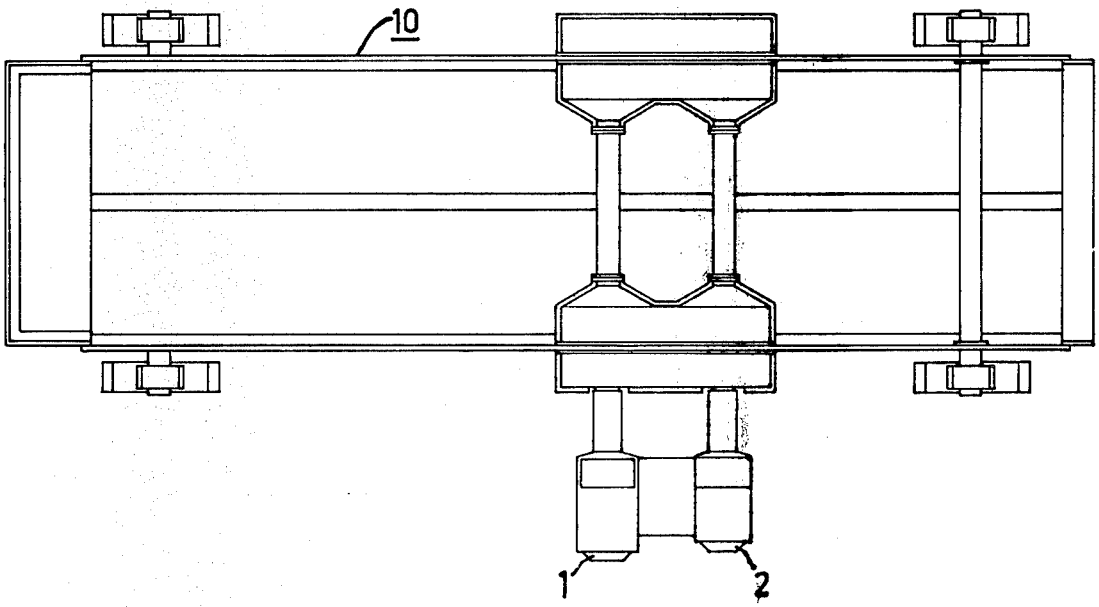
FIG. 2

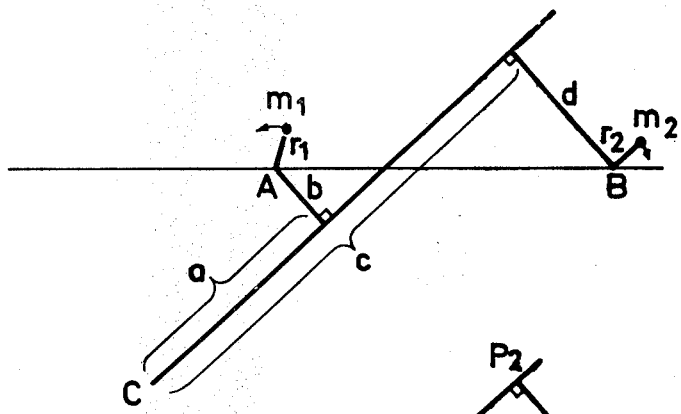
FIG. 3
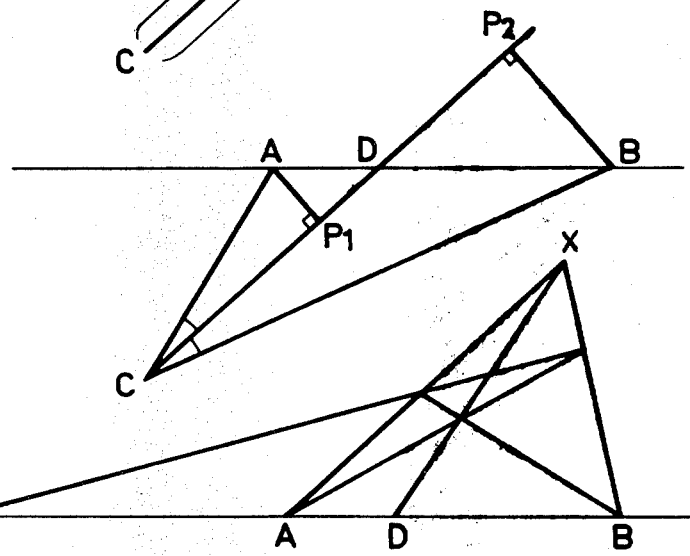
FIG. 4
FIG. 5
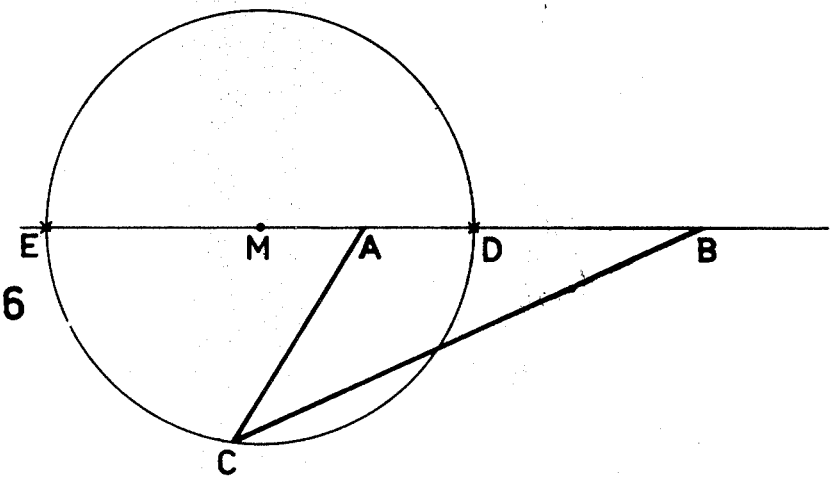
FIG. 6

DRIVE DEVICE WITHOUT TRANSMISSION FOR PRODUCING AN ELLIPTICAL SHAKING MOVEMENT

The invention relates to a mechanism for producing a shaking or oscillating movement of the type required to drive sieves, feed tables and certain conveyors, for example.

Apart from arranging mechanically guided movements with linkages and excentric means there are essentially two known types of drive mechanisms for producing the type of reciprocal movement required in installations of this type. A device which has been known for a long time is based on two identical heavily out-of-balance wheels with parallel axes. The two wheels are rotatably attached to the unit which is to be caused to oscillate and which is therefore suspended with springs or the like. The wheels are driven in opposite directions by individual electric motors, preferably of asynchronic type. It is known that the two heavily out-of-balance wheels will act on one another so that the rotations will become synchronous with one another, producing a linear, periodic impetus, aligned with the mid-point normal between the axes of rotation of the two out-of-balance wheels.

Out-of-balance weights have also been used to produce elliptical movement, which in many cases is preferable to a linear shaking movement. A known construction is described in our Swedish Pat. Specification No. 365 433. To achieve regular rotational motion of non-equal out-of-balance weights, a toothed gearing was used to unite the rotational axes of the two out-of-balance weights and achieve the required synchronization. Although the gearing used according to said patent specification is a great improvement over the prior art, the problem still remains of the necessity of a toothed gearing, which increases the mass to be oscillated, and increases costs. Experience has shown that these gearings must fulfill certain requirements (very small play for example), since otherwise striking forces can arise in the gearing.

It has been discovered quite unexpectedly that, under certain conditions, it is possible, even while working with two non-identical out-of-balance weights, to eliminate the gearing and drive the weights with individual motors, and still obtain synchronization. This experimental fact has been further investigated theoretically, resulting in a technical rule for how this effect can be achieved.

The problem of two identical out-of-balance weights driven by individual motors has been dealt with by Schmidt and Peltzer in an article in Aufbereitungs-Technik for 1976, pp 108—114. This by no means easily understood article, in which the equations of motion are derived by means of Hamilton's principle, gives the result that, firstly, with opposing directions of rotation the known linear oscillating motion is produced, and secondly, that with identical rotational movements, a circular oscillation can be produced under certain conditions. As far as we know, this is as long as the theoretical work has come in computing oscillatory movement caused by out-of-balance weights.

In our continued work to improve the construction of the gearing, we have computed which torsional forces occur in the gearings used up to now in machines for elliptical reciprocal motion. It has been found out, unexpectedly though experimentally confirmed, that even with different sizes of out-of-balance weights, a synchronizing effect can be produced between the rotations of the masses, as a result of the fact that the reciprocal motion tends to fall into a direction which is determined not only by the sizes of the out-of-balance weights and their points of action, but by the position of the center of gravity. The solution results in a stable elliptical motion whose major axis passes through the center of gravity of the oscillating mass along a line determined, firstly, by the condition that the normals from the axes of rotation to said line are inversely proportional to the products of the size of the respective masses and their mean axial distances, and secondly that the line in question bisects the angle which has its point at the center of gravity and its arms passing through the rotational axes. As will be stated below, these conditions can be formulated with the aid of Apollonios' circle.

Thus the invention relates to a driving device for producing an elliptical shaking movement in a resiliently suspended device. Said driving device comprises two oscillation masses excentrically arranged around individual rotational axes so as to be rotatable in opposite directions, the product of mass and distance to the respective rotational axis being different for the two oscilation masses.

The special advantages and characteristics are achieved according to the invention by virtue of the fact that the two oscillation masses are each rotatably arranged independently of the other and are coupled to individual motors with the same nominal r.p.m, the center of gravity of the suspended device being so disposed in relation to the two axes of rotation that a line through said center of gravity, coinciding with the major axis of the essentially elliptical shaking movement, is a bisector of the angle which has its point at the center of gravity and its arms through the axes of rotation, and passes between the two axes of rotations in such a way that the lengths of the normals from the axes of rotation to said line are inversely proportional to the products of the size of the respective oscillating masses and their mean distance to the respective axis of rotation.

This can be expressed equivalently by saying that the center of gravity of the suspended device lies on an Apollonios' circle to the axes of rotation, so determined that the ratio of the distances from the center of gravity to the axes of rotation is inversely proportional to the products of the weights of the respective oscillation masses and their mean distance to the respective axis of rotation.

A suitable ratio between the axes in the elliptical oscillation is obtained if the ratio between the products of mass times axial distance for the two oscillation masses is 2:1.

Especially when the driving device is to be used as a conveyor, but in other cases also, it can be advisable to arrange the major axis at a 45° angle to the sieve plane, which is the case if the bisector between the lines joining the center of gravity of the suspended device and the axes of rotation is thus directed.

It should be noted that in general it is recommended to place the two axes of rotation at some distance from the center of gravity, since the center of gravity can be easily displaced somewhat due to varying load. In that case, the effect of the displacement of the center of gravity on the size and direction of the oscillation will be minimal.

One should also note that the two axes of rotation can be placed either above or below the center of gravity, the suitable placement being determined by the intended use, since in certain cases it may be expedient to give them a low placement in order to to have a free space above the shaken device, for example, while in other cases a high placement can be advantageous.

The invention will now be illuminated in more detail in connection with the drawings.

FIG. 1 shows the construction of a sieve as viewed from the side.

FIG. 2 shows the same sieve viewed from above.

FIGS. 3–6 show geometric diagrams demonstrating the basic principles of the invention.

Figure 2A:
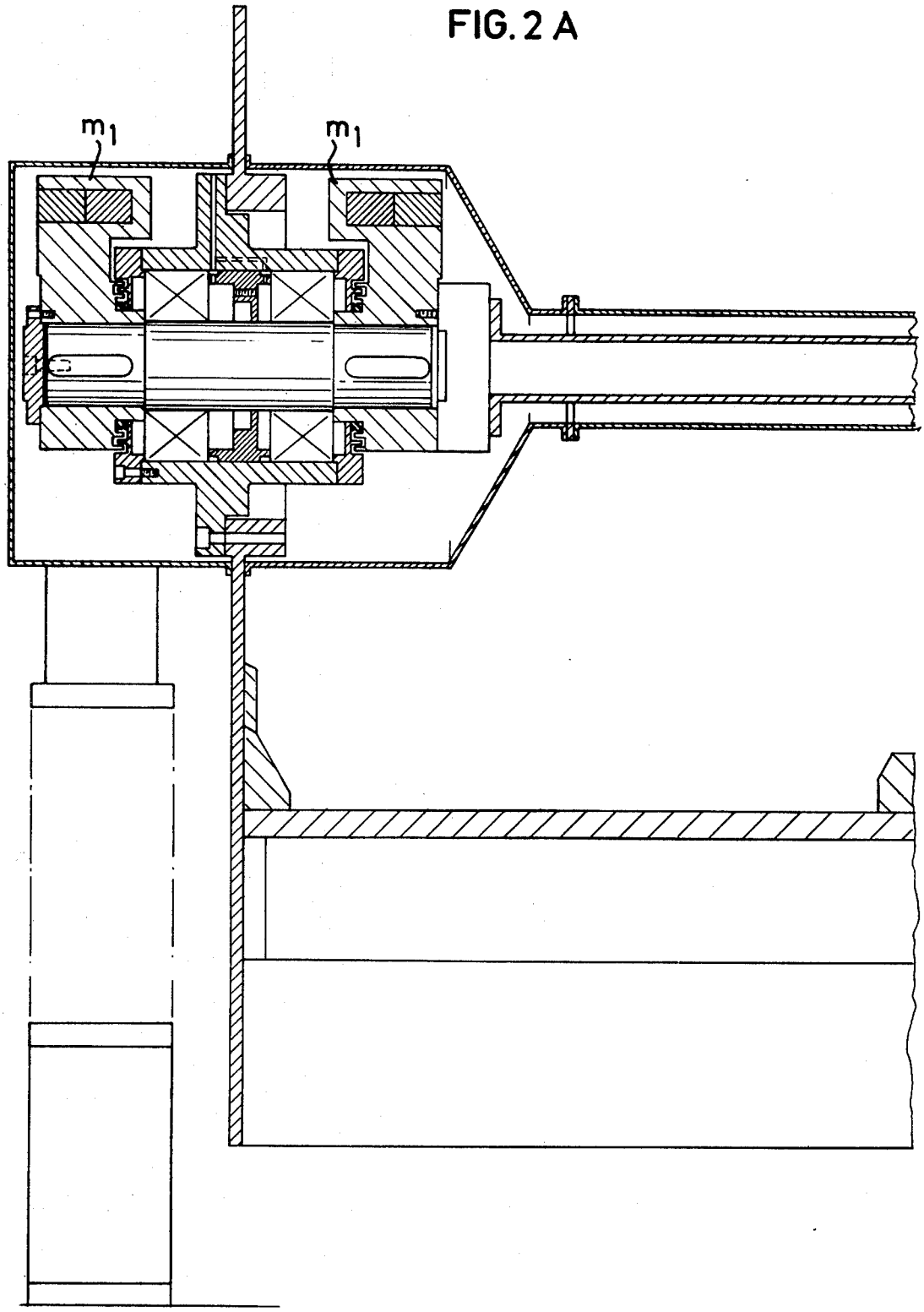
FIG. 2A shows an oscillation mass in section.

FIGS. 1 and 2 show a sieve in which the principles of the invention are applied. Two electric motors 1 and 2 drive individual oscillation masses. Said motors are mounted inside dust-protective casings (see FIG. 2A) and are arranged divided into two portions on either side of the sieve, with through-shafts for driving. The motors are mounted on a bed which does not participate in the oscillating movement of the sieve, thus holding down the oscillating mass. Between the motors and the respective oscillating mass axes, there are flexible shaft couplings, preferably consisting of shafts each provided with two universal joints (not shown). The motors are disposed for rotation in opposite directions and have the same rated ratational speed. Suitably, they are common short-circuit asynchronic motors. By being coupled via the sieve, when they are both started, they will be caused to run in time with one another, so that under certain conditions an elliptical movement of translation character is obtained for the entire spring-suspended mass, essentially free of other oscillation modes, e.g. rocking movements.

The calculations, showing exactly under what conditions elliptical motion is obtained which in principle is not complicated by other oscillation modes, are not further specified. It will suffice here to present the results, namely that the major axis of the motion must lie along a line, to which the normals from the two axes of rotation are inversely proportional to the oscillation masses times their rotational radii, and that the distances between the foot points of these normals on the line and the center of gravity shall have the same ratio.

An intuitive way of seeing that these relationships apply is to view FIG. 3 and remember that the mass forces for the two oscillation masses are proportional to the product of mass and swing radius for the masses. We now seek a solution whereby the masses move synchronically but where the movement produced must not turn around the center of gravity. We then see that when the mass forces work in conjunction, the condition for freedom from torsional force will be $m_1 r_1 b = m_2 r_2 d$, with the designations given in the figure. Also presupposing synchronic motion, one obtains for the case 90° later, when the forces are acting in the opposite directions, the condition $m_1 r_1 a = m_2 r_2 c$, so that the torques will cancel each other. The designations used are directly evident from FIG. 3.

These conditions can be written in the following manner:

$$(m_1 r_1 / m_2 r_2) = d/b = c/a \qquad (1)$$

Look now at FIG. 4, which is the same as FIG. 3, but simplified by the removal of the circles of the oscillation masses and letter labels are inserted as certain points. One can note that the triangles C $P_1$ A and C $P_2$ B which are right trianges, also, according to (1), have two sides proportional to one another making these two triangles similar. Consequently, the angles $ACP_1$ and $BCP_2$ are the same, so that the line through C, $P_1$ and $P_2$ is a bisector line. Likewise, it can be seen that the equation given in (1) is also satisfied between the triangle sides BC and AC, which is also true according to the bisector condition.

We can now treat the problem of finding all points C which satisfy (1), when points A and B are given. The problem can be formulated as the problem of finding all points for which the ratio between the distances to two given points is constant. The solution to this problem is known as Apollonios' circle, and is shown in FIG. 6. It can be constructed by first complementing the inner point of intersection D, whose distances to the two points A and B have the given ratio, with the outer point of intersection E, which also fulfills the same condition. A circle is then drawn with its center on line AB, and with its periphery passing through points D and E. This is Apollonios' circle and the desired locus.

The problem of finding the outer point of intersection can be solved in practice by drawing three lines to an arbitrary point, which we will call X, from the three known points A, B and D which lie on a line. Point D is assumed to lie between A and B. An arbitrary line is drawn from A, which intersects DX at a first point of intersection and BX at a second point of intersection. From B a line is drawn through the first point of intersection, which line intersects AX at a third point of intersection. A line is then drawn through the second and third points of intersection. Where this line intersects the line defined by A, B and D, there lies the outer intersection point sought, which divides AB in the same ratio as does the inner point of intersection D (i.e harmonic ratio).

FIG. 5 shows this method of constructing the outer point of intersection, whereby Apollonios' circle can be drawn as per FIG. 6.

The elliptical motion produced by the out-of-balance weights will, as has already been said, have its major axis along the bisector CD. We then see that there will be two special cases, namely when the center of gravity of the system lies at either one of points D or E. Apparently, even in these cases, solutions with elliptical motion will be obtained, with the degenerated minor or major axis of the ellipse placed along the connection line AB between the axes of rotation.

Purely with regard to practical embodiment, if it is desired to use the invention in a sieve for example, it is advisable to take certain factors into account. Some of the theoretical solutions are more interesting than others. For example, it is advantagous to place the center of gravity of the system far from the axes of rotation in order to reduce the effect of oblique load on the sifted material. It is also evident from FIG. 6 that the axes of rotation can be placed either below or above the center of gravity of the system.

The relationship between the products of mass and rotational radius for the oscillation masses determines the relationship between the major axis and the minor axis for the oscillation ellipse (presupposing that the suspension is symmetrical). This ratio can be calculated from the expression:

$$(m_1 r_1 + m_2 r_2)/(m_1 r_1 - m_2 r_2)$$

A suitable ratio between the major and minor axes is 3:1, yielding the result that $m_1 r_1 : m_2 r_2 = 2:1$.

The construction shown in FIGS. 1 and 2 has a suspended mass of about 1000 kg. The masses rotate around centers which lie at a distance from one another of 100 cm and are comparable to point masses of 65 and 35 kg respectively with mean radii of 20 cm. It has been shown that an elliptical motion is obtained when a=50 cm, c=93 cm, b=15 cm and d=28 cm (designations according to FIG. 3). This corroborates the theory experimentally. (If the oscillation masses take up large angles around the axes, then a cosine correction must be made of course when integrating to determine the effective mean distance or mean radius.)

By way of summary, it can be said that the invention makes possible the production of better and less expensive driving devices for elliptical oscillatory motion. The invention makes it possible to eliminate the heavy and not very inexpensive gear box. In the example shown, the two motors have been placed outside the oscillating system, which is generally most suitable. However, there is nothing to prevent placing the motors in the spring-suspended arrangement, if this should be suitable for other reasons.

We have thus shown that it is possible, with different sized oscillation masses, to achieve an elliptical shaking movement, essentially free of other than translational movement, despite the lack of a gearbox. It is obvious that a minor deviation from the construction rule invented by us would result in a certain deviation from elliptical translational motion, e.g. a superimposed oscillation. It is our intention that even such modifications made by a person skilled in the art according to needs and means based on our rule, shall also fall under the patent claims.

What we claim is:

1. Drive device for producing an elliptical oscillating movement in a spring-suspended apparatus, said drive device comprising two oscillation masses eccentrically arranged around individual axes of rotation and rotatable in opposite directions, the product of mass and distance to the respective axis of rotation being different for the two oscillation masses, characterized in that the two oscillation masses are each rotatably arranged independently of the other and are coupled to individual motors with the same nominal rotational speed, and that the center of gravity of the suspended device lies on an Apollonios' circle to the axes of rotation, so determined that the ratio of the distances from the center of gravity to the axes of rotation is inversely proportional to the products of the weights of the respective oscillation masses and their mean distance to the respective axis of rotation.

2. Drive device according to claim 1, characterized in that the ratio between the products of the weights of the oscillation masses and their mean distances to the respective axes of rotation is essentially 2:1.

3. Drive device according to claim 1 or 2, characterized in that the bisector of those lines which join the center of gravity of the suspended apparatus to the axes of rotation forms essentially a 45° angle with a sieve plane.

* * * * *